US011447216B2

(12) United States Patent
Barnes

(10) Patent No.: US 11,447,216 B2
(45) Date of Patent: Sep. 20, 2022

(54) FLOATING PLATFORM

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 112 days.

(21) Appl. No.: 17/079,813

(22) Filed: Oct. 26, 2020

(65) Prior Publication Data

US 2021/0039761 A1 Feb. 11, 2021

Related U.S. Application Data

(63) Continuation-in-part of application No. 16/830,343, filed on Mar. 26, 2020, which is a continuation-in-part of application No. 16/794,670, filed on Feb. 19, 2020, now Pat. No. 10,822,063.

(Continued)

(51) Int. Cl.
*B63C 1/02* (2006.01)
*B63B 35/38* (2006.01)

(Continued)

(52) U.S. Cl.
CPC ..... *B63C 1/02* (2013.01); *B63B 35/38* (2013.01); *E02B 3/064* (2013.01); *B63B 75/00* (2020.01);

(Continued)

(58) Field of Classification Search
CPC ..... B63C 1/02; B63B 35/38; B63B 75/00; E02B 3/064; E02B 17/06
See application file for complete search history.

(56) References Cited

U.S. PATENT DOCUMENTS 3,074,239 A * 1/1963 Mustard ..... E02B 3/068 5/294
3,270,698 A 9/1966 Fort (Continued)

FOREIGN PATENT DOCUMENTS

DE 2042850 3/1972
FR 2860819 4/2005

(Continued)

OTHER PUBLICATIONS https://www.jetdock.com (excerpt printed Jan. 29, 2020).

(Continued)

*Primary Examiner* — S. Joseph Morano
*Assistant Examiner* — Jovon E Hayes
(74) *Attorney, Agent, or Firm* — B. Craig Killough

(57) ABSTRACT

A floating platform is attached to another object. The object may be fixed to the earth or it may be a floating object such as a floating dock or a vessel. The floating platform is held in horizontal position relative to the object to which it is attached, but vertical movement of the floating platform relative to the object is permitted. The object is connected to the floating platform by devices that have blades extending from. Each blade slidably engages a bracket, with the slidable blade permitting horizontal adjustment of the distance of the floating platform from the object during installation of the floating platform. Guide posts or piles slidably engage pile guides mounted to the object, permitting the floating platform to move vertically relative to the object, but fixing the floating platform's horizontal position relative to the object.

21 Claims, 13 Drawing Sheets

Related U.S. Application Data

(60) Provisional application No. 62/851,783, filed on May 23, 2019.

(51) Int. Cl.

| | |
|---|---|
| ***E02B 3/06*** | (2006.01) |
| *E02B 17/06* | (2006.01) |
| *B63B 75/00* | (2020.01) |
| *E02B 17/00* | (2006.01) |

(52) U.S. Cl.
CPC ..... *E02B 17/06* (2013.01); *E02B 2017/0056* (2013.01)

(56) References Cited

U.S. PATENT DOCUMENTS

| | | | | |
|---|---|---|---|---|
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |
| 4,948,300 | A * | 8/1990 | Bateson | E02B 3/068 405/220 |
| 5,002,000 | A | 3/1991 | Rutter | |
| 5,016,551 | A | 5/1991 | Peck et al. | |
| 5,046,897 | A | 9/1991 | Ray | |
| 5,106,237 | A * | 4/1992 | Meldrum | E02B 3/068 405/221 |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 59,416,650 | | 8/1999 | Rueckert | |
| 6,145,463 | A | 11/2000 | Zeilinger | |
| 6,179,525 | B1 | 1/2001 | Gruhn et al. | |
| 6,477,968 | B2 | 11/2002 | Powell | |
| 6,526,902 | B1 | 3/2003 | Faber | |
| 6,547,485 | B2 | 4/2003 | Elson | |
| 6,648,554 | B1 * | 11/2003 | Sehl | B63B 21/50 441/35 |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 8,267,621 | B1 | 9/2012 | Way | |
| 8,528,494 | B2 * | 9/2013 | Moody | B63B 59/02 114/263 |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| 10,000,902 | B1 * | 6/2018 | Huml | E02B 3/068 |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 * | 4/2019 | Barnes | E02B 3/064 |
| 10,370,073 | B2 | 8/2019 | Barnes | |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0248420 | A1 * | 10/2007 | Jacobs | F16B 7/044 405/218 |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2009/0302572 | A1 * | 12/2009 | Bryant, II | B60P 3/1075 414/532 |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2014/0010593 | A1 | 1/2014 | Davis | |
| 2016/0368577 | A1 | 12/2016 | Gaveau | |

FOREIGN PATENT DOCUMENTS

| | | |
|---|---|---|
| FR | 3017595 | 6/2014 |
| RU | 2529124 | 9/2014 |
| WO | WO9914110 | 3/1999 |
| WO | WO2014035026 | 3/2014 |
| WO | WO2016053208 | 4/2016 |

OTHER PUBLICATIONS

Shoremaster, LLC, Official RhinoHoist Front Mount Floating Boat Life Video, YouTube, May 10, 2013, https://www.youtube.com/watch7v-ayxgoTHCijl.

* cited by examiner

FLOATING PLATFORM

This application is a Continuation in Part of application Ser. No. 16/794,670 filed Feb. 19, 2020, U.S. Pat. No. 10,822,063, and a Continuation in Part of application Ser. No. 16/830,343, filed Mar. 26, 2020, which claims the benefit of Application Ser. No. 62/851,783, filed May 23, 2019, the benefit of which is claimed hereby.

Floating platforms, such as docks and rafts, are used to store boats, stage materials, or provide walkways over water. There is a need for a floating dock that can be quickly constructed, and will float on top of water as water levels change due to tides, wave action and other causes.

SUMMARY OF THE INVENTION

A floating platform is attached to another object. The object may be fixed to the earth or it may be a floating object such as a floating dock or a vessel. The floating platform is held in horizontal position relative to the object to which it is attached, but vertical movement of the floating platform relative to the object is permitted. The object is connected to the floating platform by devices that have blades extending from. Each blade slidably engages a bracket, with the slidable blade permitting horizontal adjustment of the distance of the floating platform from the object during installation of the floating platform. Guide posts or piles slidably engage pile guides mounted to the object, permitting the floating platform to move vertically relative to the object, but fixing the floating platform's horizontal position relative to the object.

BRIEF DRAWING DESCRIPTION

Figure 8:
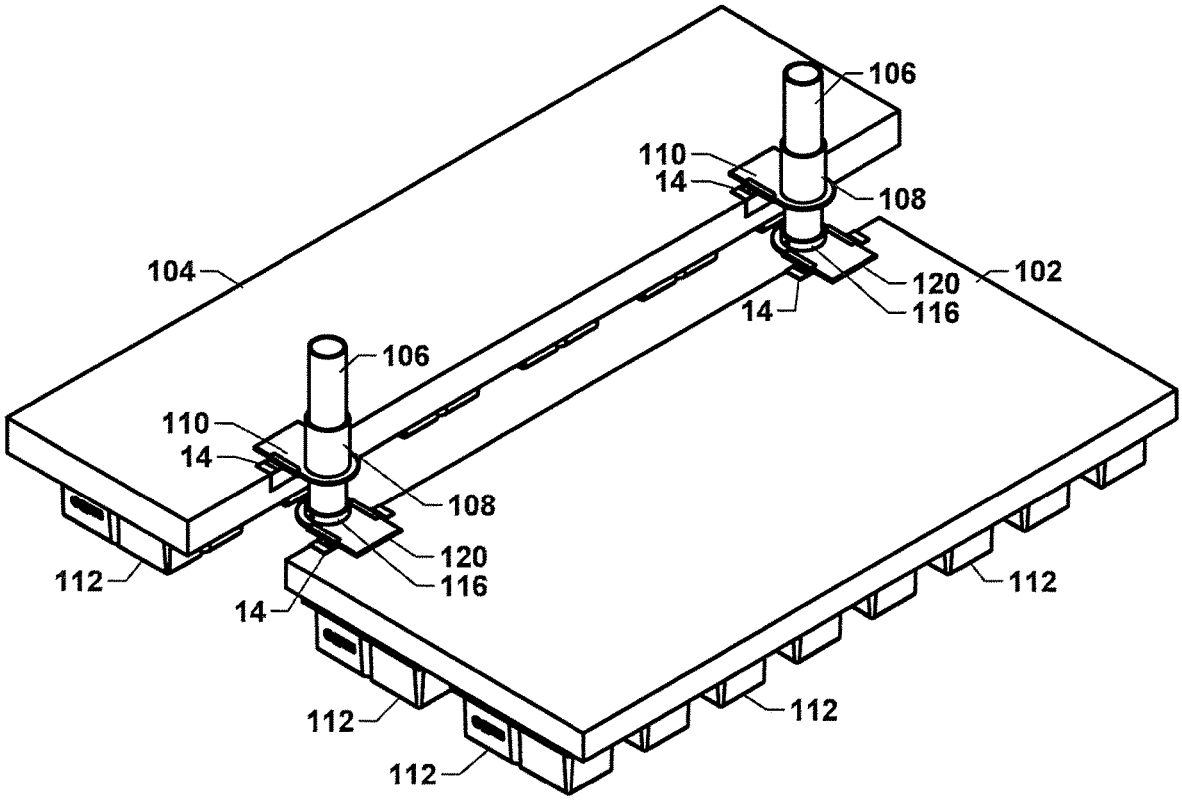
FIG. 8 is a perspective view of another embodiment of the invention in which a guide post is mounted to a slidable mounting.
Figure 9:
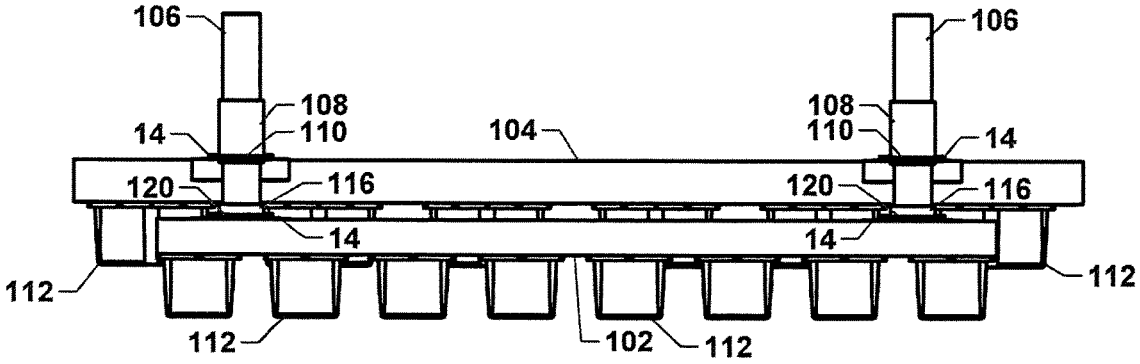
FIG. 9 is an elevation of the embodiment of FIG. 8.
Figure 10:
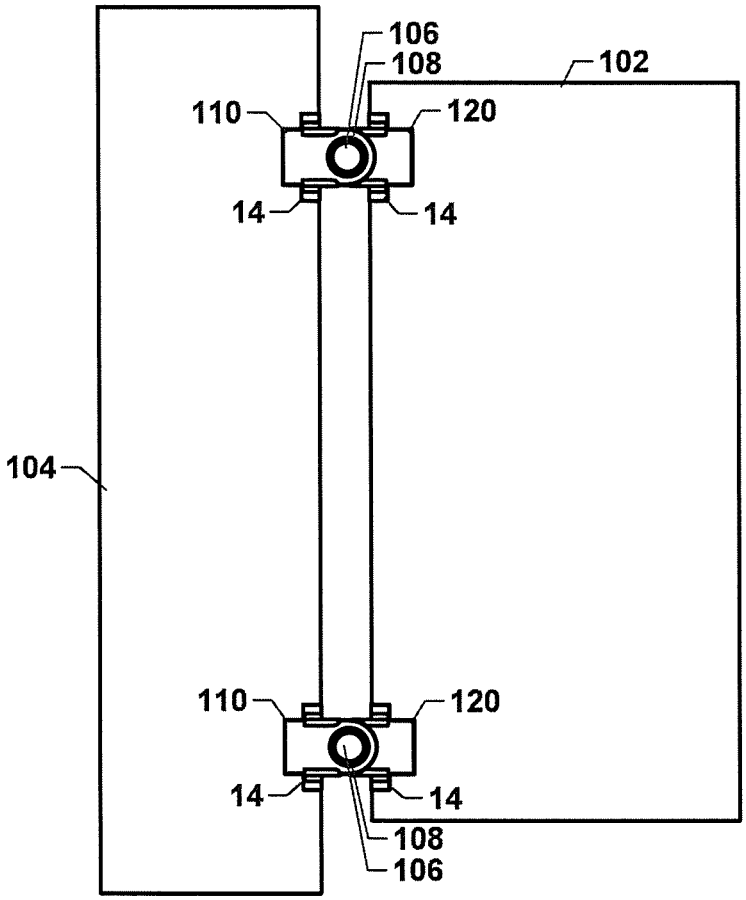
FIG. 10 is a top plan view of the embodiment of FIG. 8.
Figure 11:
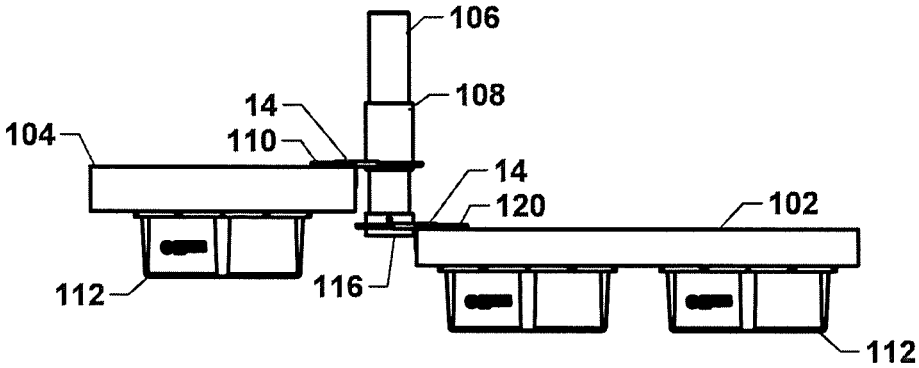
FIG. 11 is a side elevation of the embodiment of FIG. 8.
Figure 12:
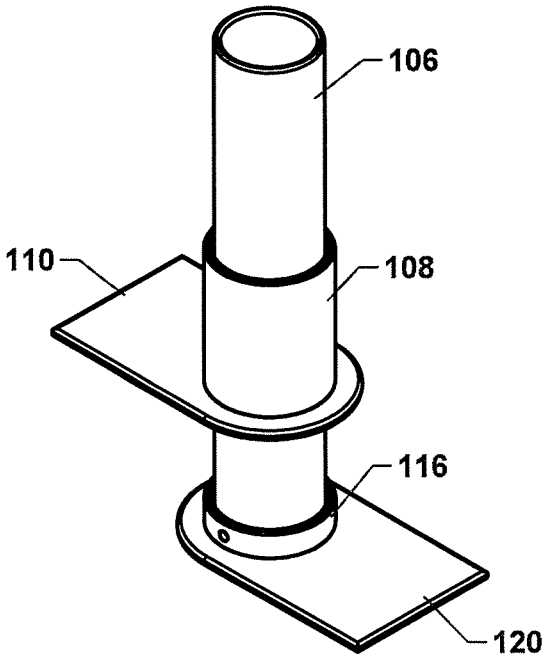

FIG. 12 demonstrates in isolation a guide post that is attached to and extends above the slidable mounting and is slidable relative to a guide that is slidably mounted to an object according to the embodiment of FIG. 8.

Figure 13:
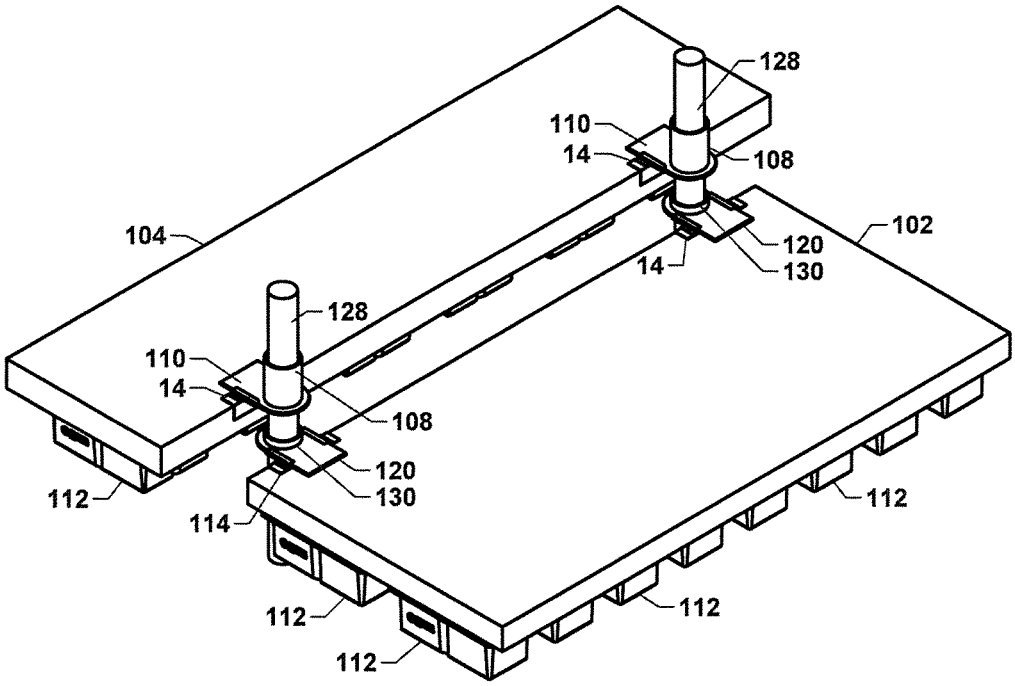

FIG. 13 is a perspective view of another embodiment of the invention in which a pile driven into the earth extends through pile guides associated with a floating platform and an object.

Figure 14:
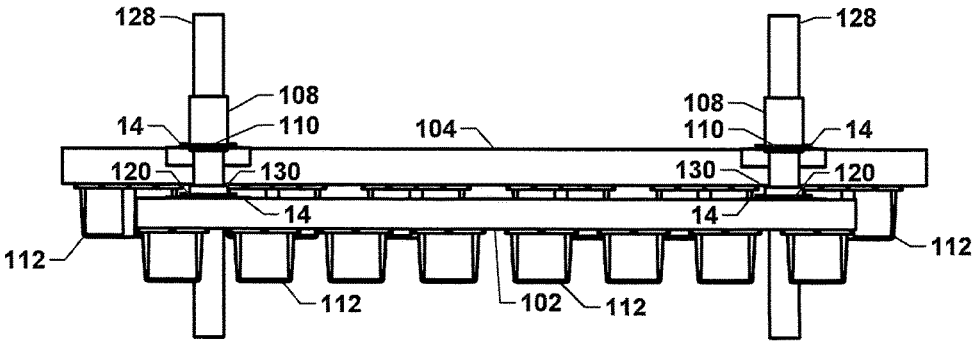

FIG. 14 is an elevation of the embodiment of FIG. 13.

Figure 15:
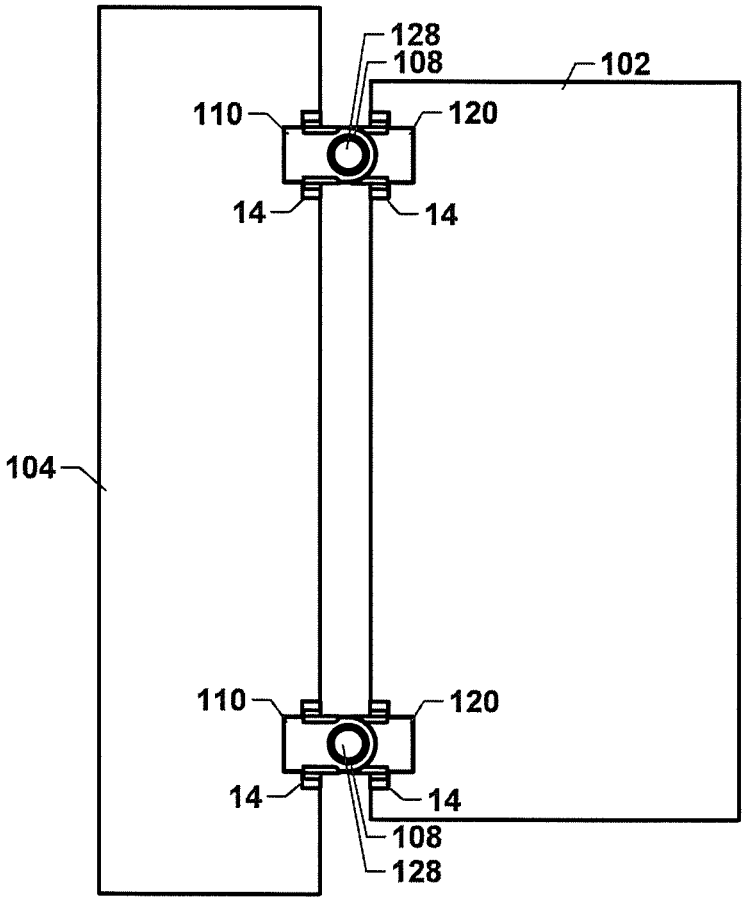

FIG. 15 is a top plan view of the embodiment of FIG. 13.

Figure 16:
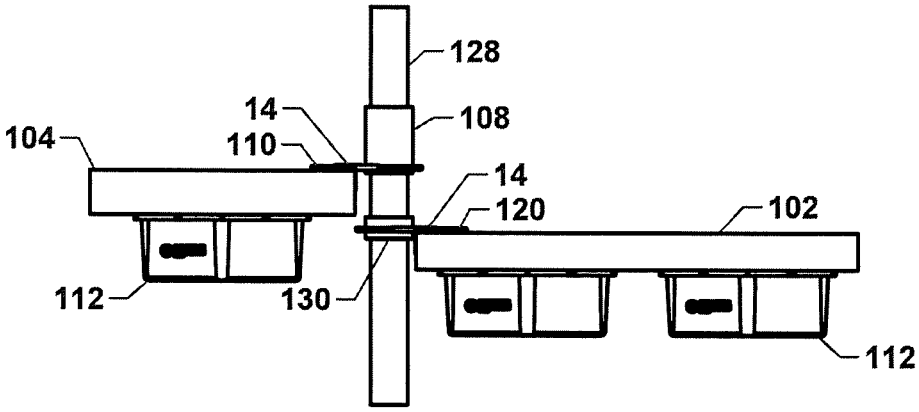

FIG. 16 is a side elevation of the embodiment of FIG. 13.

Figure 17:
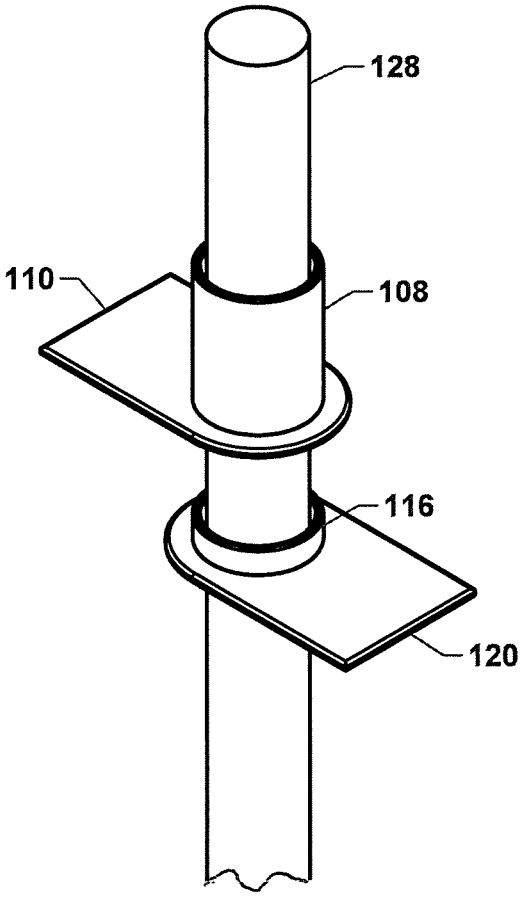

FIG. 17 demonstrates in isolation the pile driven into the earth extending above a guide that is slidably mounted to the object and is slidably mouthed to the floating platform according to the embodiment of FIG. 13.

Figure 18:
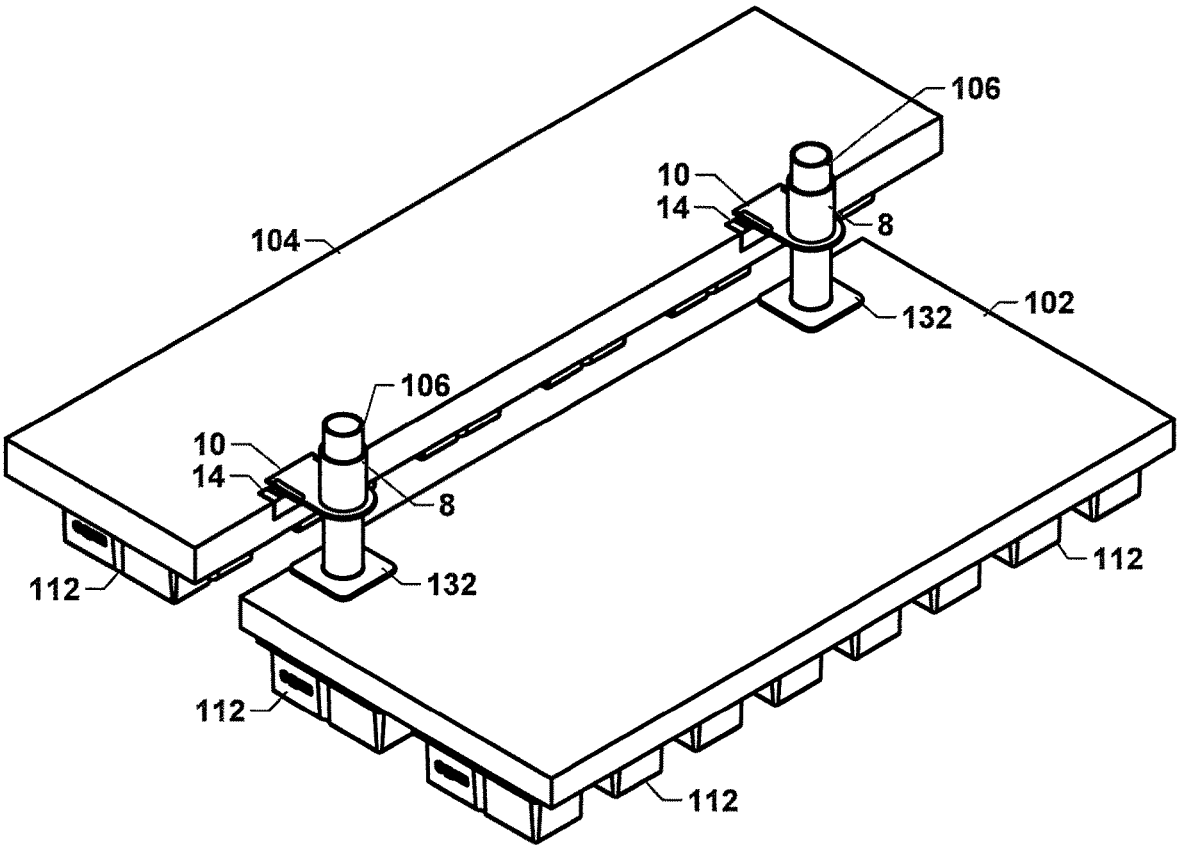

FIG. 18 is a perspective view of another embodiment of the invention in which a guide post is attached to the floating platform and extends through the pile guide mounted to the object.

Figure 19:
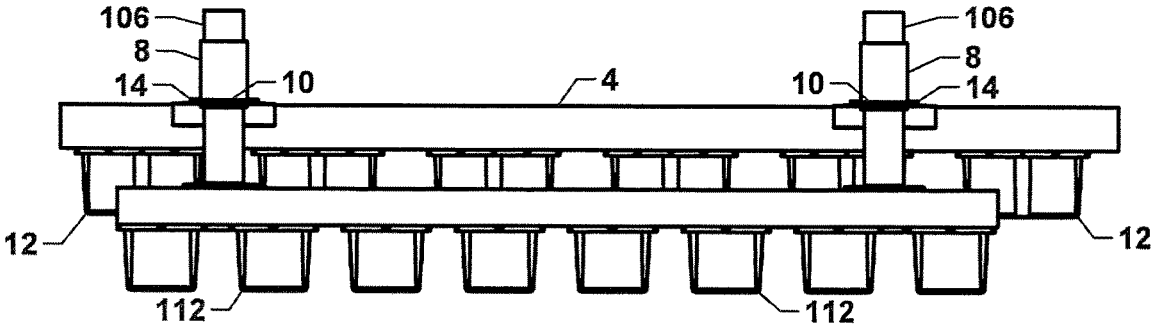

FIG. 19 is an elevation of the embodiment of FIG. 18.

Figure 20:
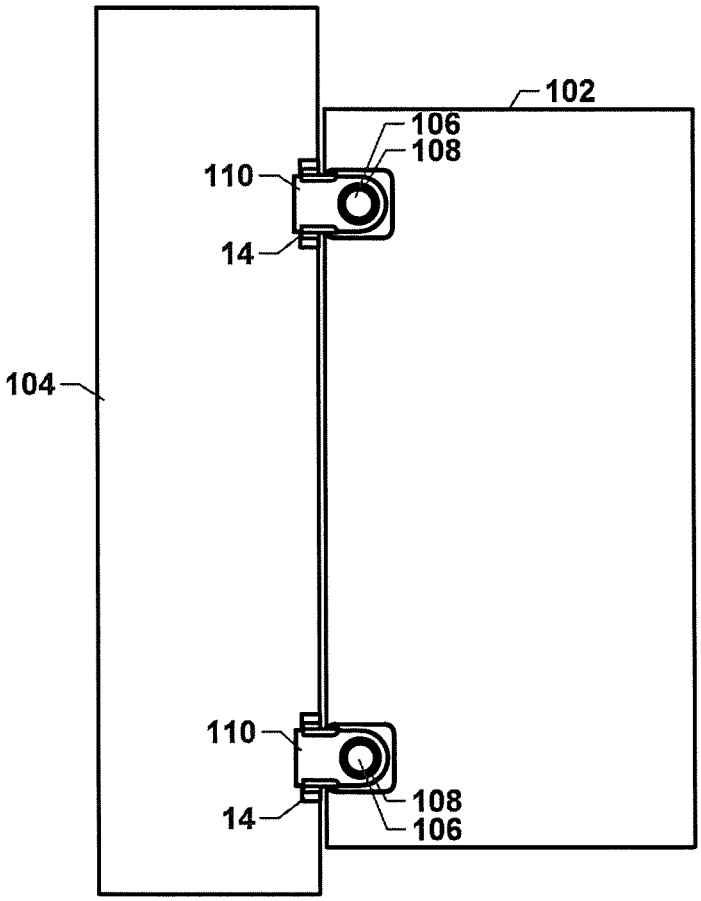

FIG. 20 is a top plan view of the embodiment of FIG. 18.

Figure 21:
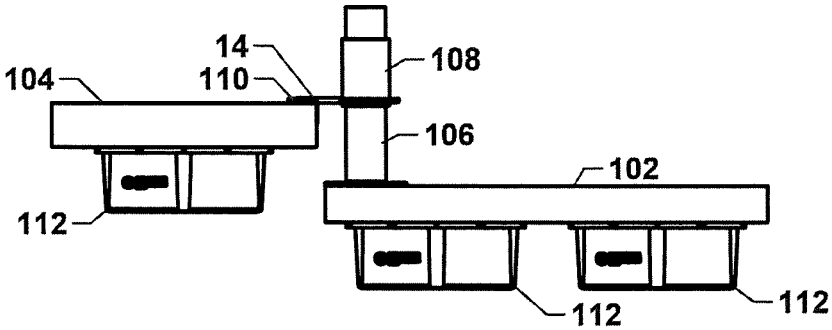

FIG. 21 is a side elevation of the embodiment of FIG. 18.

Figure 22:
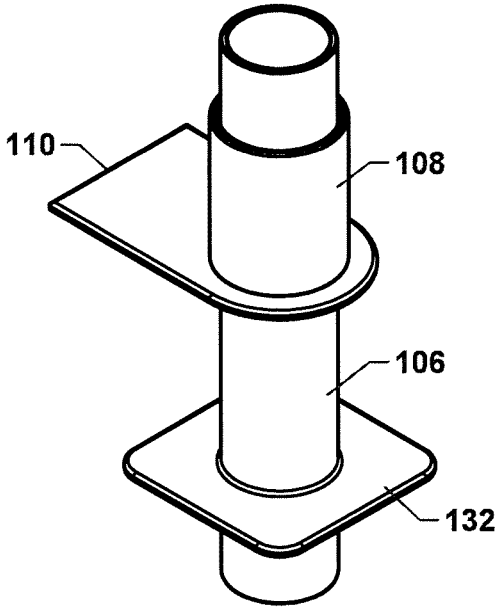

FIG. 22 demonstrates in isolation the guide post attached to the floating platform and the guide that is slidably mounted to an object according to the embodiment of FIG. 18

DESCRIPTION OF PREFERRED EMBODIMENTS

Figure 1:
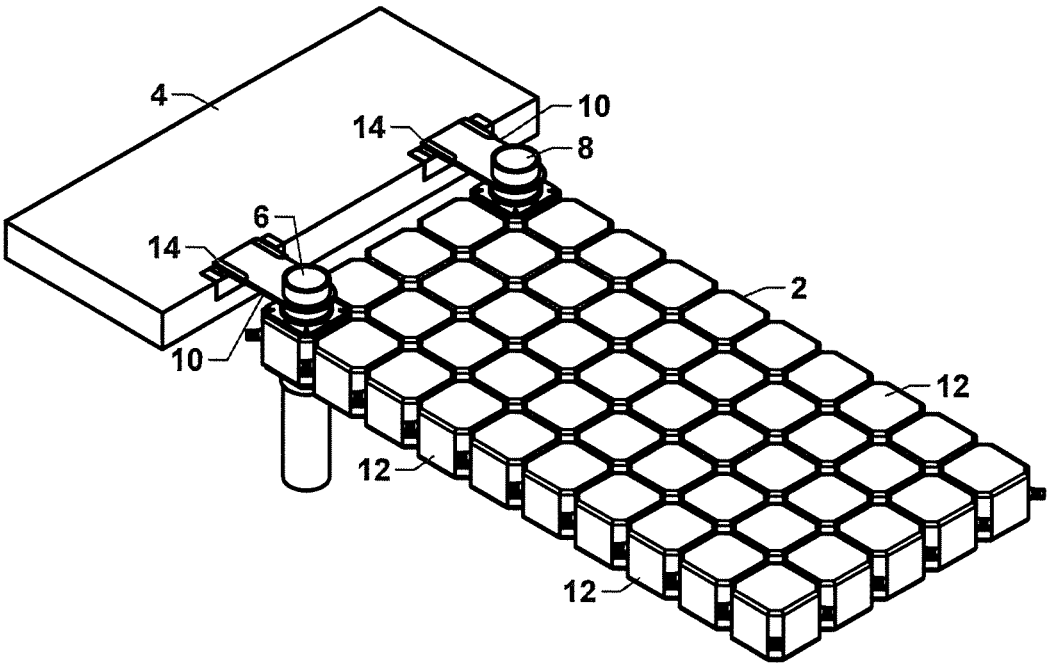
FIG. 1 is a perspective view of the floating platform according to the invention.
Figure 2:
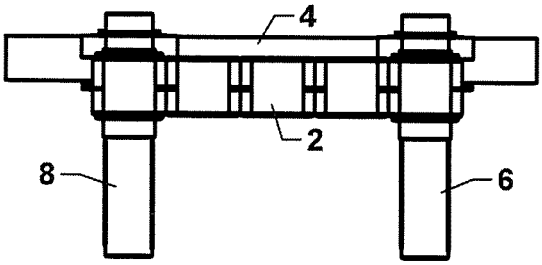
FIG. 2 is an elevation of the end the floating platform according to the invention.
Figure 3:
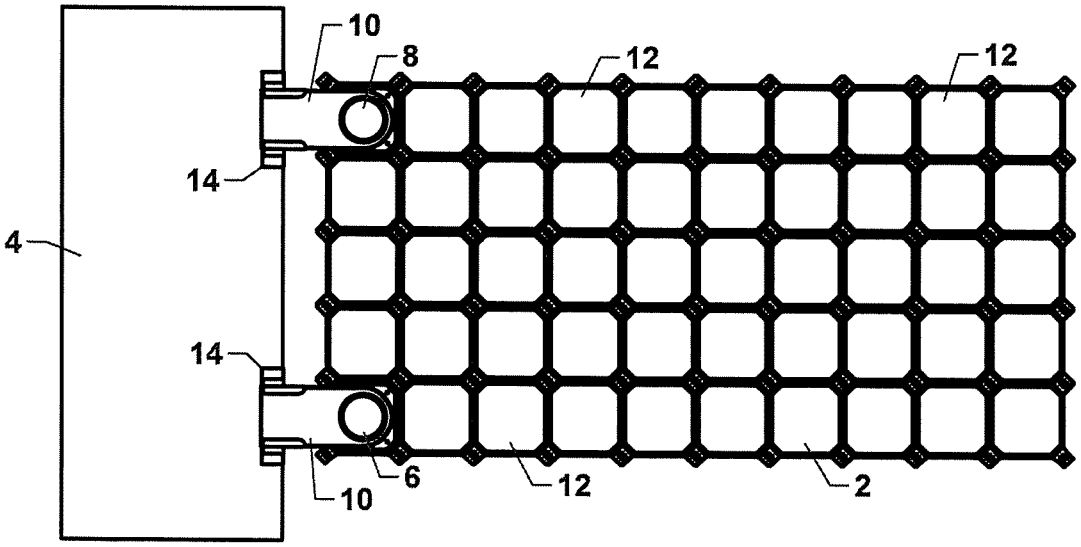
FIG. 3 is a top plan view of the floating platform.
Figure 4:
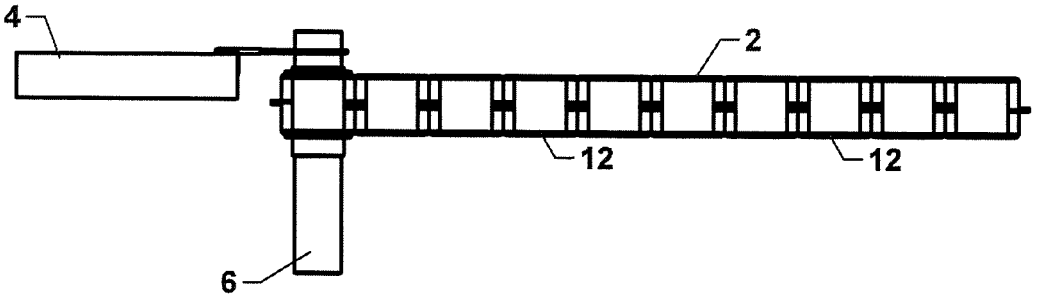
FIG. 4 is a side elevation of the floating platform.
Figure 5:
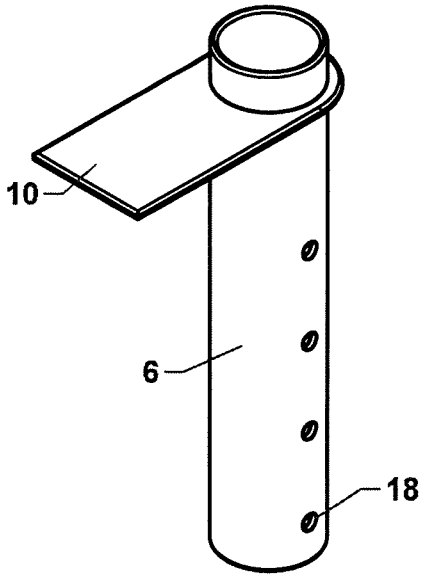
FIG. 5 is a perspective view of a guide post used with an embodiment of the invention.
Figure 6:
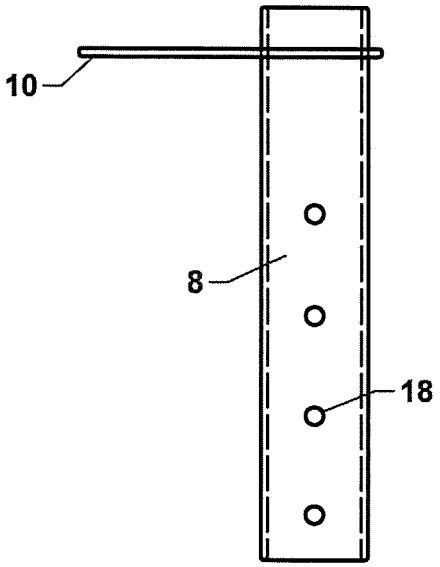
FIG. 6 is an elevation of the guide post shown in FIG. 5.
Figure 7:
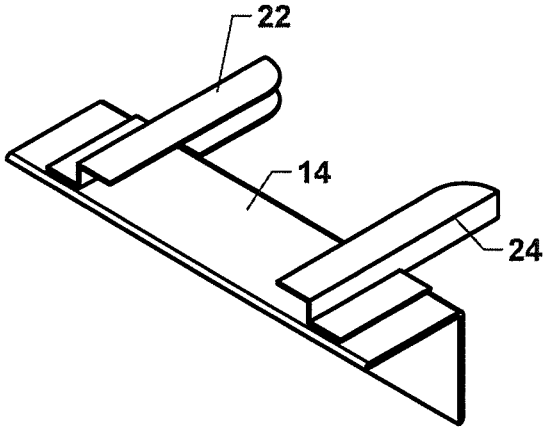
FIG. 7 is a perspective view of a bracket for receiving a blade of the guide post of FIG. 5.

The floating platform comprises a floating platform 2. The floating platform may be a floating dock or a raft or other platform that will float in water. The floating platform may be formed of wood, plastic or other materials that will float in water. As shown in the drawing figures, the floating platform is formed of a plurality of individual floating units 12 that are connected to form a rectangular floating platform. The floating platform as shown in FIG. 1 also has a generally level and planar top surface and can be used as a boat dock with the boat stored on top of the boat dock. The floating platform may be used as a staging area for tools and materials, or the floating platform may be used as a walkway, such as a catwalk. The floating platform may be formed in shapes other than a rectangular shape, and need not have a planar top surface.

Forming the floating platform 2 of individual floating units 12 allows the floating platform to be constructed in a desired shape and dimensions, and also allows quick assembly of the floating platform. The floating platform has particular utility as a temporary facility that can be quickly assembled. Further, the use of individual units to form the floating platform, or the use of other modular construction of the floating platform, allows for easy transportation of the floating platform which can be assembled on site, and without the necessity of special highway transportation.

The invention allows the floating platform 2 to be held in place relative to another object 4 without substantial horizontal movement of the floating platform. However, the floating platform according to the invention allows vertical movement of the floating platform relative to the object due to changes in water levels due to tides, weather, or wave action. The object may be in position relative to the earth or the object may be another floating object. For example, the object could be a bulkhead fixed to the shore, or the object could be another floating platform or floating dock or the additional object could be a vessel, such as a ship or a boat. Whether the object is fixed or floating, the floating platform construct of the invention allows vertical movement of the floating platform relative to the object while holding the floating platform substantially in position horizontally, although the horizontal positioning may be adjusted.

Guide posts 6,8 are used to connect the floating platform 2 to the object 4. A preferred guide post is an elongated object that engages receptacles formed in and extending through the floating platform. The guide posts each comprise a horizontal blade 10 that extends from a side of the guide post and near a top of the guide post.

In a preferred embodiment, at least two brackets 14 are mounted to the object 4. Each bracket has opposing members 22,24 that allow the blade 10 of a guide post 6,8 to slidably engage the bracket between the opposing members. The blade may be formed to a desired length, so that the floating platform 2 may be horizontally spaced from the object at a desired distance. With the blade being slidable within the brackets, this distance may be adjusted as desired by the user. After positioning the blades between the brackets, the distance of the floating platform to the object is adjusted and the blade is fixed to a position within the brackets such as by using one or more set screws to hold the blade and the guide post in a horizontal position relative to the object. The guide posts thereby hold the floating platform in a horizontal position relative to the object. The blades of the guide posts are positioned above the floating platform.

In one embodiment the brackets 14 are mounted under the object and/or under the floating platform. The blades of the pile guides slidably engage the brackets as described. Mounting the brackets and pile guides on a lower surface rather than a top surface of the object and/or floating platform removes and obstruction or tripping hazard from the top of the object and/or floating platform.

The guide posts 6,8 engage receptacles formed in and extending through the floating platform 2. The guide posts are fixed in position relative to the object as described above, but the floating platform moves vertically relative to the guide posts as the floating platform floats in changing water levels. The fit of the guide posts within the receptacles is such that the receptacles, and therefore the floating platform, can traverse the guide posts in a vertical direction. The floating platform can move vertically independent of the object 4 to which the floating platform is attached. In this manner, if the object is fixed to the earth, changes in water levels do not submerge the floating platform. Similarly, if the floating platform is attached to a floating object, such as a large vessel, the floating object has less tendency to pull the floating platform under the water in the event of violent wave action.

The guide posts 6,8 may be formed to a length that is required by the application. For example, if the object 4 is fixed to the earth and the floating platform 2 is subject to two (2) meter tides, the guide posts may have a length of three (3) meters or more. In some applications it may be desirable to have a stop on the guide posts. The stop may be a pin inserted through a void 18 of the guide post so that the floating platform does not disengage from the guide post in the event of an extremely low water level due to tides, wave action or other causes.

The guide posts 6,8 may have a round cross section, and form an elongated cylindrical shape. If the guide posts are hollow, a cap may be placed over the top of the guide posts, so that the guide post may be used as a step for entering or leaving the floating platform 2. The receptacles are formed as voids having a complementary shape to the guide posts so that the floating platform moves vertically the guide posts as water levels change. The guide posts and receptacles could have other complimentary shapes. The receptacles and guide posts are preferred to be formed of polyethylene, and particularly high density polyethylene, which is extremely durable, corrosion resistant, and has low friction qualities that facilitate the movement required by the objects of the invention. Low density polyethylene may be used in other applications.

In a preferred embodiment, the guide posts have a specific gravity of less than 1.0 so that they float in water and provide buoyancy to retard deflection of the blade over time. In a specific embodiment the guide posts are hollow but are capped or otherwise sealed to prevent water intrusion into the center of the guide posts so as to provide buoyancy. The hollow guide posts may be made of materials having a specific gravity of less than 1.0. An example of such materials is polyethylene.

FIGS. 8-12 show an additional embodiment of the invention. The floating platform 102 may be a floating dock or similar platform that will float in water. The floating platform may be formed of floating members. The floating platform may be formed of wood, plastic or other materials that will float in water. The floating platform may have a hard surface, such as a surface formed of wood planking. The floating platform as shown in FIG. 8 may have a generally level and planar top surface. The floating platform may be configured for use as a boat dock with the boat stored on top of the floating platform and out of the water, such as a v-shape for accommodating a boat hull. The floating platform may be used as a staging area for tools and materials, or the floating platform may be used as a walkway, such as a catwalk. The floating platform may be formed in shapes other than a rectangular shape, and may not have a planar top surface.

The invention allows the floating platform 102 to be held in place relative to another object 104 without substantial horizontal movement of the floating platform. However, the floating platform according to the invention allows vertical movement of the floating platform relative to the object due to changes in water levels due to tides, weather, or wave action. The object may be in a fixed position relative to the earth or the object may be another floating object with floats 112. For example, the object could be a bulkhead fixed to the shore, or the object could be another floating platform or floating dock or the additional object could be a vessel, such as a ship or a boat. Whether the object is fixed or floating, the floating platform construct of the invention allows vertical movement of the floating platform relative to the object while holding the floating platform substantially in position horizontally, although the horizontal positioning may be adjusted.

At least two brackets 14 are mounted to the object 104. Each bracket has opposing members that allow the blade 110 of a guide to slidably engage the bracket between the opposing members. The blade 110 may be formed to a desired length, so that the floating platform 102 may be horizontally spaced from the object at a desired distance. With the blade being slidable within the brackets, this distance may be adjusted as desired by the user. After positioning the blades between the brackets, the horizontal distance of the floating platform to the object is adjusted and the blade is fixed to a position within the brackets such as by using a set screw to hold the blade and the guide post in a horizontal position relative to the object. The guide posts thereby hold the floating platform in a position relative to the object.

Guide posts 106 engage a cylinder 108 that extends above the blade 110. The blade, cylinder and bracket form a pile guide that limits horizontal movement of the guide posts and the floating platform 102 relative to the object 104. In this embodiment, the guide posts are fixed to blades 120 that slide relative to brackets 14 attached to the floating platform. The guide posts may be mounted to the blades 120 by a collar 116 that holds the guide post in position. The blades 120 may be formed to a desired length and positioned within the brackets so that the floating platform 102 may be horizontally spaced from the object at a desired distance, just as the object 104 may be spaced at a desired distance from the guide posts and floating platform through the use of the slidable blades 110. With the blades 120 being slidable within the brackets, this distance may be adjusted as desired by the user or installer. After positioning the blades between the brackets, the horizontal distance of the guide posts to the floating platform is adjusted and the blade is fixed to a position within the brackets, such as by using one or more set screws to hold the blade and the guide posts in the desired position.

In this embodiment the floating platform 102 is free to move vertically relative to the object 104 as the floating platform and/or the object floats in changing water levels. The fit of the guide posts 106 within the cylinder 108 is such that the guide posts, and therefore the floating platform, can move or slide vertically within the cylinder and move vertically relative to the object 104. The cylinder and the guide posts may be formed in other geometric shapes, and could be square in cross section for example, and long as relative movement is provided as described. The floating platform can move vertically independently of the object 104 to which the floating platform is attached. In this manner, if the object is fixed to the earth, changes in water levels do not submerge the floating platform. Similarly, if the floating platform is attached to a floating object, such as a large vessel, the floating object has less tendency to pull the floating platform under the water in the event of violent wave action.

The guide posts 106 may be formed to a length that is required by the application. For example, if the object 104 is fixed to the earth and the floating platform 102 is subject to two (2) meter tides, the guide posts may have a length of three (3) meters or more. In some applications it may be desirable to have a stop on the guide posts. The stop may be a pin inserted through a void of the guide post so that the floating platform does not disengage from the cylinder 108 in the event of an extremely low water level due to tides, wave action or other causes.

The guide posts 106 may have a round cross section, and form an elongated cylindrical shape. The cylinders 108 comprise voids having a complementary shape to the guide posts so that the floating platform moves vertically relative to the object 104 as water levels change. The guide posts and cylinders may have other complimentary shapes. The receptacles and guide posts are preferred to be formed of polyethylene, and particularly high density polyethylene, which is extremely durable, corrosion resistant, and has low friction qualities that facilitate the movement required by the objects of the invention. Low density polyethylene may be used in other applications.

FIGS. 13-17 show an embodiment that is similar to the embodiment of FIGS. 8-12, with the object 104, floating platform 102 and associated components being the same as indicated by like reference numbers. In this embodiment, the guide posts are static piles 128 driven into the earth. The piles slidably engage pile guides 130 that are mounted to the floating member such as a floating dock and to pile guides 108 mounted to the object. In this embodiment the floating platform 102 moves vertically relative the piles 128 as the floating platform and/or the object floats in changing water levels. The fit of the piles within the pile guides is such that floating platform can move vertically relative to the fixed piles and move vertically relative to the object. The pile guides and the piles may be formed in desired geometric cross sections, and could be round or square in cross section for example, and long as relative movement is provided as described.

FIGS. 18-22 show an embodiment that is similar to the embodiments of FIGS. 8-17, with the object 104, floating platform 102 and associated components being the same as indicated by like reference numbers. In this embodiment, the guide posts 106 are mounted to the floating platform 102 such as by mounting 132, and therefore move as the floating platform moves. The guide posts slidably engage pile guides 108 that are mounted to the object. In this embodiment the floating platform moves vertically relative to the object as the floating platform and/or the object floats in changing water levels. The fit of the guide posts within the pile guides is such that floating platform can move vertically relative to the object 104. The pile guides and the guide posts may be formed in desired geometric cross sections, and could be round or square in cross section for example, and long as relative movement is provided as described.

What is claimed:

1. A floating construct, comprising:

a floating platform, the floating platform comprising, a first bracket, a second bracket, a first guide post comprising a horizontal blade, the first guide post extending above the floating platform, a second guide post comprising a horizontal blade, the second guide post extending above the floating platform, wherein the horizontal blade of the first guide post is retained within the first bracket and a length of an extension of the horizontal blade of the first guide post from the first bracket is adjustable; and wherein the horizontal blade of the second guide post is retained within the second bracket and a length of an extension of the horizontal blade of the second guide post from the second bracket is adjustable.

2. A floating construct as described in claim 1, wherein the first guide post is attached to and extends above the horizontal blade of the first guide post and the second guide post is attached to and extends above the horizontal blade of the second guide post.

3. A floating construct as described in claim 1, further comprising a third bracket, a fourth bracket, a first pile guide having an opening therein constructed and arranged for the first guide post to slidably engage the opening in the first pile guide, wherein horizontal movement of the first guide post is restricted by the first pile guide, the first pile guide comprising a horizontal blade extending from the third bracket, a second pile guide having an opening therein constructed and arranged for the second guide post to slidably engage the opening in the second pile guide, wherein horizontal movement of the second guide post is restricted by the second pile guide, the second pile guide comprising a horizontal blade extending from the fourth bracket.

4. A floating construct as described in claim 3, wherein the floating platform is positioned below the horizontal blade of the first pile guide and the horizontal blade of the second pile guide.

5. A floating construct as described in claim 3, wherein the third bracket and the fourth bracket are mounted to a floating object.

6. A floating construct as described in claim 3, wherein the third bracket and the fourth bracket are mounted to an object fixed to the earth.

7. A floating construct as described in claim 3, wherein the first pile guide and the second pile guide are formed of polyethylene.

8. A floating construct as described in claim 1, wherein the first guide post and the second guide post are formed of polyethylene.

9. A floating construct as described in claim 1, wherein the floating platform is a boat dock.

10. A floating construct as described in claim 1, wherein the first guide post and the second guide post have an elongated cylindrical shape.

11. A floating construct, comprising:

a first bracket, a second bracket, a first pile guide having an opening therein constructed and arranged to slidably engage a first pile, the first pile guide comprising a horizontal blade extending from the first bracket, a second pile guide having an opening therein constructed and arranged to slidably engage a second pile, the second pile guide comprising a horizontal blade extending from the second bracket, wherein the horizontal blade of the first guide post is retained within the first bracket and a length of an extension of the horizontal blade of the first guide post from the first bracket is adjustable; and wherein the horizontal blade of the second guide post is retained within the second bracket and a length of an extension of the horizontal blade of the second guide post from the second bracket is adjustable, and wherein the first bracket and the second bracket are mounted to a floating platform.

12. A floating construct as described in claim 11, the floating platform comprising a first pile guide and a second pile guide, wherein the first pile guide of the floating platform is constructed and arranged to slidably engage the first pile and the second pile guide of the floating platform is constructed and arranged to slidably engage the second pile.

13. A floating construct as described in claim 11, wherein the first pile extends above the floating platform and the second pile extends above the floating platform, and the horizontal blade of first pile guide is positioned above the floating platform.

14. A floating construct as described in claim 11, wherein the first bracket is mounted to an object fixed to the earth.

15. A floating construct as described in claim 11, wherein the first bracket is mounted to a floating object.

16. A floating construct, comprising:

a floating platform, the floating platform comprising, a first guide post extending above the floating platform, a second guide post extending above the floating platform, a first bracket, a second bracket, a first pile guide having an opening therein constructed and arranged for the first guide post to slidably engage the opening in the first pile guide, wherein horizontal movement of the first guide post is restricted by the first pile guide, the first pile guide comprising a horizontal blade extending from the first bracket, a second pile guide having an opening therein constructed and arranged for the second guide post to slidably engage the opening in the second pile guide, wherein horizontal movement of the second guide post is restricted by the second pile guide, the second pile guide comprising a horizontal blade extending from the second bracket.

17. A floating construct as described in claim 16, wherein the first bracket is mounted to an object fixed to the earth.

18. A floating construct as described in claim 16, wherein the first bracket is mounted to a floating object.

19. A floating construct as described in claim 16, wherein the floating platform is positioned below the horizontal blade of the first pile guide and the horizontal blade of the second pile guide.

20. A floating construct, comprising:

An object, the object comprising, a first bracket, a second bracket, a first pile guide comprising a horizontal blade, the horizontal blade of the first pile guide slidably engaging the first bracket, a second pile guide comprising a horizontal blade, the horizontal blade of the second pile guide slidably engaging the second bracket, a first guide post that engages a floating platform a second guide post that engages the floating platform the first pile guide having an opening therein constructed and arranged for the first guide post to slidably engage the opening in the first pile guide, the second pile guide having an opening therein constructed and arranged for the second guide post to slidably engage the opening in the second pile guide, wherein horizontal movement of the floating platform is restricted by the first pile guide and the second pile guide.

21. A floating construct as described in claim 20, wherein the first guide post and the second guide post extend above an engagement of the first guide post and the second guide post with the floating platform.

* * * * *